US012637745B2

(12) United States Patent
He et al.

(10) Patent No.: US 12,637,745 B2
(45) Date of Patent: May 26, 2026

(54) TEMPERING-FREE WEAR-RESISTANT HOT ROLLED STRIP AND METHOD FOR PRODUCING SAME

(71) Applicant: WUHAN IRON AND STEEL COMPANY LIMITED, Wuhan (CN)

(72) Inventors: Yayuan He, Wuhan (CN); Jinqiao Xu, Wuhan (CN); Yang Zhang, Wuhan (CN); Pengwu Zhang, Wuhan (CN); Yue Wang, Wuhan (CN); Yunyang Yin, Wuhan (CN); Tangguo Hu, Wuhan (CN); Liwei Li, Wuhan (CN); Haihe Luo, Wuhan (CN); Bin Liu, Wuhan (CN)

(73) Assignee: WUHAN IRON AND STEEL COMPANY LIMITED, Wuhan (CN)

( * ) Notice: Subject to any disclaimer, the term of this patent is extended or adjusted under 35 U.S.C. 154(b) by 730 days.

(21) Appl. No.: 18/069,992

(22) Filed: Dec. 21, 2022

(65) Prior Publication Data

US 2023/0125540 A1 Apr. 27, 2023

Related U.S. Application Data

(63) Continuation of application No. PCT/CN2021/102485, filed on Jun. 26, 2021.

(30) Foreign Application Priority Data

Jun. 28, 2020 (CN) ..... 202010595525.X

(51) Int. Cl.
*C22C 38/14* (2006.01)
*B21B 37/16* (2006.01)
(Continued)

(52) U.S. Cl.
CPC ..... *C22C 38/14* (2013.01); *B21B 37/16* (2013.01); *B21B 37/74* (2013.01); *C21D 3/02* (2013.01);
(Continued)

(58) Field of Classification Search
CPC ..... C22C 38/001; C22C 38/02; C22C 38/04; C22C 38/06; C22C 38/12; C22C 38/14;
(Continued)

(56) References Cited

U.S. PATENT DOCUMENTS

| | | | |
|---|---|---|---|
| 6,855,218 | B1 | 2/2005 | Kawalla et al. |
| 8,852,356 | B2 | 10/2014 | Spitzer et al. |
| 10,053,757 | B2 | 8/2018 | Hanlon et al. |

FOREIGN PATENT DOCUMENTS

| | | | | |
|---|---|---|---|---|
| CN | 101041879 | A | * | 9/2007 |
| CN | 103805851 | A | | 5/2014 |

(Continued)

*Primary Examiner* — Anthony M Liang

(57) ABSTRACT

A tempering-free wear-resistant hot rolled strip, includes components in percentage by weight: 0.08-0.22% of C, 0.1-0.55% of Si, 0.8-1.5% of Mn, less than or equal to 0.012% of P, less than or equal to 0.005% of S, 0.01-0.055% of Als, 0.005-0.019% of Ti, and less than or equal to 0.007% of N. A method for producing the same includes: desulfurizing molten iron, smelting desulfurized molten iron, and casting into a blank; heating the casting blank; performing rough rolling; performing finish rolling; performing rapid cooling; performing coiling; and performing conventional temper rolling. According to the present disclosure, on the premise that the tensile strength of a steel plate is greater than or equal to 1100 MPa and the elongation is greater than or equal to 12%, the steel plate has a surface Brinell hardness of 330-390 and a core hardness that is 95% or above of the surface hardness.

3 Claims, 1 Drawing Sheet

(51) Int. Cl.

| | |
|---|---|
| ***B21B 37/74*** | (2006.01) |
| ***C21D 3/02*** | (2006.01) |
| ***C21D 8/02*** | (2026.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| *B21B 1/22* | (2006.01) |

(52) U.S. Cl.
CPC ..... *C21D 8/02* (2013.01); *C21D 8/0226* (2013.01); *C21D 9/46* (2013.01); *C22C 38/001* (2013.01); *C22C 38/02* (2013.01); *C22C 38/04* (2013.01); *C22C 38/06* (2013.01); *B21B 2001/225* (2013.01); *B21B 2267/12* (2013.01)

(58) Field of Classification Search
CPC ..... C21D 3/02; C21D 6/005; C21D 8/0205; C21D 8/0226; C21D 8/0263; C21D 9/46; B21B 2001/225; B21B 2267/12; B21B 37/16; B21B 37/74
See application file for complete search history.

(56) References Cited

FOREIGN PATENT DOCUMENTS

| | | | |
|---|---|---|---|
| CN | 104928579 | A | 9/2015 |
| CN | 105177415 | A | 12/2015 |
| CN | 109097664 | A | 12/2018 |
| JP | 2018188675 | A | 11/2018 |

* cited by examiner

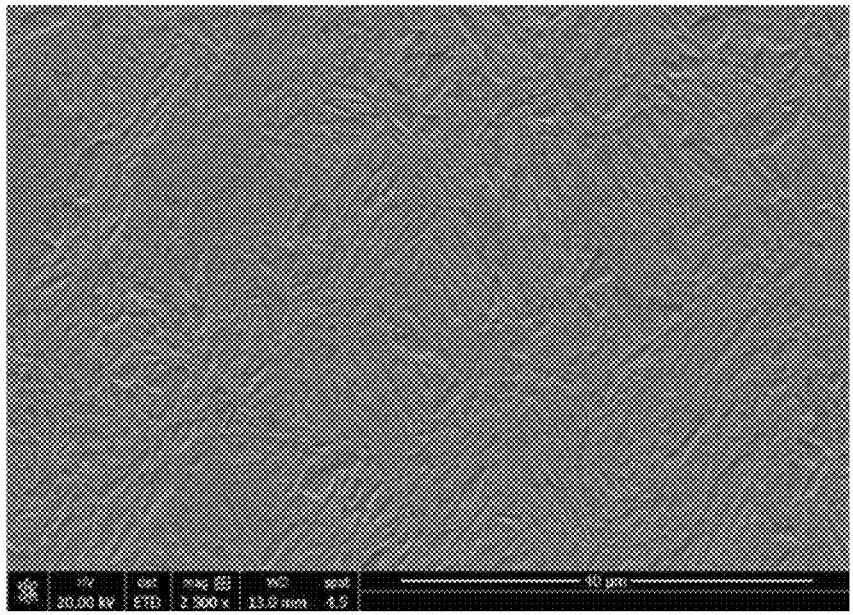

TEMPERING-FREE WEAR-RESISTANT HOT ROLLED STRIP AND METHOD FOR PRODUCING SAME

CROSS-REFERENCE TO RELATED APPLICATIONS

This application is a continuation of International Patent Application No. PCT/CN2021/102485 with a filing date of Jun. 25, 2021, designating the United States, and further claims priority to Chinese Patent Application No. 202010595525.X with a filing date of Jun. 28, 2020. The content of the aforementioned applications, including any intervening amendments thereto, are incorporated herein by reference.

TECHNICAL FIELD

The present disclosure relates to wear-resistant steel and a method for producing the same, in particular to a tempering-free wear-resistant hot rolled strip and a method for producing the same, which is particularly applicable to a wear-resistant steel plate with a thickness of 3-12 mm for engineering machinery and production. The tempering-free wear-resistant hot rolled strip can be applied to manufacturing wear-resistant components such as a compartment of a dumper and a scraper pan of an excavator.

BACKGROUND

Wear-resistant steel is one of the important basic materials, which is widely used in mining machinery, coal mining and transportation, engineering machinery, building materials, electrical machinery, railway transportation and other fields. Foreign wear-resistant steel, such as HARDOX series from SSAB OXELOSUND, XAR series from Germany ThyssenKrupp, and EVERHARD series from Japan JFE, is in a leading position in research and development and production, with a thickness specification covering products at all grades of HB300-600 in 3-100 mm.

In recent years, China has made significant progress in the research and development, as well as production, of wear-resistant steel. Some enterprises can stably supply wear-resistant steel plates with the hardness HB450 or below in batches, which are reliable in quality and recognized by the market. However, they are produced by a traditional offline quenching and tempering process, that is, offline thermal treatment needs to be performed on steel plates. There are problems such as high alloy cost, long process, and high relative energy consumption.

Chinese patent Document No. CN1109919A discloses low alloy wear-resistant steel, including the following components in percentage by weight: 0.5-0.6% of C, 0.9-1.2% of Si, 1.4-1.7% of Mn, 1.35-1.60% of Cr, 0.3-0.5% of Mo, 0.05-0.10% of V, 0.03-0.06% of Ti, and 0.02-0.04% of Re. Both the strength and wear resistance are good. However, adding a large amount of alloying elements to improve the hardenability of Mo, Cr, etc. is costly, and the high content of C and Si easily causes quenching cracks, which may affect the use by users.

Chinese patent Document No. CN103114253A discloses a method for producing an ultra-thin ultra-high-strength steel plate. Its production process includes pure steel smelting, hot continuous rolling forming, coiled plate uncoiling and flattening, hot rolled substrate quenching and tempering, controlling of a heating temperature of a casting blank, exertion of the action of high reduction during rolling, and excavation of the maximum potential of thermal treatment, so that an ultra-thin ultra-high-strength steel plate with a finished product thickness of 3-10 mm and a tensile strength of 1000-1500 Mpa is produced by ensuring an ultrafine structure by the technical means. This steel plate has excellent low-temperature toughness index, an equivalent carbon content of less than or equal to 0.4%, good welding performance, and applicability to large-scale production. However, offline quenching and tempering is required, which causes a long process route, high energy consumption, high production cost and insufficient use of waste heat after rolling. Under the background that the steel industry is developing towards short process and low energy consumption, the market competitiveness is low.

In theory, an online quenching process can completely replace the offline quenching process. However, due to a large cooling rate and a large cooling water volume of online quenching, a steel plate is basically in a free state after finishing rolling, in addition to a certain tension. How to ensure a good coiling shape and plate shape of a steel plate at an ultra-high cooling rate is the key to the success of the online quenching process.

It can be seen that the existing wear-resistant steel has shortcomings of high alloy cost, long process route caused by offline quenching and tempering, and the like, resulting in high production cost and insufficient market competitiveness.

SUMMARY

For the shortcomings in the prior art, the present disclosure provides a tempering-free wear-resistant hot rolled strip and a method for producing the same. On the premise of ensuring that the tensile strength of a steel plate is greater than or equal to 1100 MPa and the elongation is greater than or equal to 12%, the steel plate has a surface Brinell hardness of 330-390 and a core hardness that is 95% or above of the surface hardness, and no expensive elements are added; and furthermore, tempering is not required, but only online quenching is used.

Technical measures to achieve the above purpose are as follows:

a tempering-free wear-resistant hot rolled strip includes the following components in percentage by weight: 0.08-0.22% of C; 0.1-0.55% of Si; 0.8-1.5% of Mn; less than or equal to 0.012% of P; less than or equal to 0.005% of S; 0.01-0.055% of Als; 0.005-0.019% of Ti; less than or equal to 0.007% of N, and the balance of Fe and impurities, and a structure is lath martensite.

Preferably, the weight percentage of B added is less than or equal to 0.005%.

Preferably, the weight percentage of C is 0.08-0.15%.

Preferably, the weight percentage of Mn is 0.8-1.38%.

Preferably, the weight percentage of Ti is 0.005-0.015%.

Preferably, the weight percentage of Als is 0.01-0.048%.

Preferably, the weight percentage of Si is 0.10-0.46%.

A method for producing the tempering-free wear-resistant hot rolled strip includes the following steps:

1) desulfurizing molten iron, smelting the desulfurized molten iron, and casting into a blank;
2) heating the casting blank: wherein a heating temperature is controlled at 1220-1270° C., and the temperature is maintained for at least 60 min; a total duration in a furnace is controlled to be 140 min or more; and a temperature difference in a plate thickness direction is controlled to not exceed 5° C.;

3) performing rough rolling, and wherein a rough rolling end temperature is controlled at 1050-1110° C., and a thickness of an intermediate plate at the end is 30-50 mm;

4) performing finish rolling, wherein an initial rolling temperature is controlled at 950-1050° C., a rolling speed is controlled to be 2-7 m/s, and a final rolling temperature of the finish rolling is controlled to be 830-880° C.;

5) performing rapid cooling, namely cooling to 350° C. or below at a cooling rate of 40-150° C./s, and controlling an upper and lower cooling water ratio to be 45:55-75:80;

6) performing coiling, wherein a coiling temperature is controlled at 300-400° C., and a coiling tension is controlled to be 10-20 t; and 7) performing conventional temper rolling to control a waviness to not exceed 4.5 mm/m.

Preferably, the casting blank is heated at 1228-1263° C. Preferably, the coiling is performed at 275-340° C.

Mechanisms and actions of the various components and the main processes in the present disclosure:

C: C is the cheapest element to improve the wear resistance of a material. With the increase of the carbon content, the hardness, the strength and the wear resistance increase, but the plasticity, the toughness and the welding performance decrease. In overall consideration, the weight percentage of C is 0.08-0.22%, preferably 0.08-0.15%. When the content of C is higher than an upper limit of the range, there may be a risk that the strength and the hardness are too high, but the plasticity and toughness significantly decrease. Once a user bends a steel plate, it is extremely easy to cause cracks. When the content of C is less than a lower limit of the range, it is necessary to add many elements to improve the hardenability, which will significantly increase the cost.

Si: It can significantly reduce the critical cooling rate of steel, making a final product form a fine martensite structure. Among common solid solution elements, Si is second only to P. When solid-dissolved in ferrite and austenite, Si can improve the hardness and the strength. Si can reduce the diffusion speed of carbon in the ferrite, making carbides precipitated during tempering difficult to gather, improving the tempering stability, reducing the oxidation effect during friction heating, and improving the cold deformation hardening rate and wear resistance. However, when the content of Si is higher than an upper limit of the range, excessive iron oxide scales and poor surface quality will be caused, which may affect the use of users and the surface quality of finished products. When the content of Si is less than a lower limit of the range, the stability of the austenite will become worse. There may be only martensite in a microstructure. Without the soft phase effect of the austenite, the yield ratio of the finished products increases, and the machining properties become worse. This will not only affect the plate shape quality after straightening, but also is not conducive to the machining and use of steel plates by users. In overall consideration, the weight percentage of Si is 0.1-0.8%, preferably 0.10-0.46%.

Mn: The element can significantly reduce the Ar1 temperature of steel, the austenite decomposition speed and the martensite transformation temperature. Manganese can also significantly reduce the critical quenching speed of steel. Infinite solid solution with Fe can improve the hardness and strength. However, if the content of Mn is too high, it will increase the tempering brittleness of the steel, resulting in serious central segregation. In overall consideration, the weight percentage of Mn is 0.8-1.8%, preferably 0.08-1.38%.

Als: It not only achieves deoxidization in the steel of the present disclosure, but also plays a role in refining grains. In overall consideration, it is selected that the weight percentage of Als is 0.01-0.06%, preferably 0.01-0.048%.

Ti: Ti has an extremely strong affinity with N, O and C, and has a stronger affinity with S than iron. It is a good deoxidizing and degassing agent and an effective element for fixing N and C, which can improve the strength of steel. In overall consideration, the weight percentage of Ti is 0.005-0.03%, preferably 0.005-0.015%.

B: B can significantly improve the hardenability of steel, but too high content of B are easily enriched at a grain boundary, which is unfavorable to the toughness. In overall consideration, the weight percentage of B does not exceed 0.005%.

N: The impact of N on the properties of steel is similar to that of C and P. With the increase of the content of N, the strength increases significantly, the plasticity, especially the toughness, decreases significantly, the weldability becomes worse, and the cold brittleness increases. At the same time, the aging tendency increases. N is easily bonded with B in steel to form BN, which reduces the effect of B of improving the hardenability and reduces the content of effective B. Therefore, in overall consideration, N is less than or equal to 0.005%.

P and S: P and S are harmful impurity elements in steel. P in the steel is easy to segregate in the steel, reducing the toughness and welding performance of the steel. S is easily formed into plastic sulfides, which will cause delamination of a steel plate and deteriorate the performance of the steel plate. Therefore, the lower the content of P and the content of S, the better. In overall consideration, the content of P and the content of S in the steel satisfy $P \leq 0.012\%$ and $S \leq 0.005\%$.

The reason why the thickness of the intermediate plate is controlled to be 30-50 mm at the end of rough rolling in the present disclosure is that when the thickness of an intermediate slab is greater than 50 mm, the reduction rate at a finish rolling stage will increase. On one hand, the increase of the reduction rate will refine grains, improve the yield ratio of a finished product, reduce the machinability, and greatly increase the difficulty in improving a plate shape of a cooled steel coil in a uncoiling and flattening process. On the other hand, a large reduction rate will cause a high rolling load in the finish rolling process, which is neither conducive to producing ultra-thin steel plates nor conducive to obtaining excellent rolled plate shapes. However, when the thickness of the intermediate slab is less than 30 mm, it means that the reduction rate in the rough rolling stage is too large and the rolling load is high and easily exceeds equipment limits, which affects the normal operation of the equipment. It also means that the reduction rate in the finish rolling stage is too small, and it is difficult to ensure the mechanical properties of the finished product.

The reason why, in the finish rolling stage, the rolling speed is controlled to be 2-7 m/s and the final rolling temperature of the finish rolling is controlled to be 830-880° C. in the present disclosure is that a rolling speed interval is conducive to uniformly controlling a cooling process. A too high or too low rolling speed will not be conducive to ensuring a plate shape quality after cooling, and the plate shape quality is the key to the control of the method. If the final rolling temperature is too high, the cooling strength in the cooling stage will increase. The high cooling strength under an ultra-rapid cooling condition will deteriorate the plate shape quality after cooling. However, if the final rolling temperature is too low, the steel plate will easily enter a two-phase zone for rolling, which will not only affect the stability of the rolling process, but also easily lead to the appearance of ferrite in a finished product structure, reducing the performance.

The reason why cooling is performed to be 350° C. or below at a cooling rate of 40-150° C./s, achieving online quenching and the upper and lower cooling water ratio is controlled to be 45:55-75:80 in the present disclosure is that under this composition system, a too low cooling rate makes it difficult to ensure the cooling uniformity of the steel plate, especially a thick steel plate, in the thickness direction, and a too high cooling rate makes it difficult to stabilize the plate shape quality of the cooled steel plate in any process. A martensite structure can be stably obtained only when cooling is performed to 350° C. or below, and a certain degree of distribution of C can also occur, which makes the austenite more stable and is conducive to obtaining a mixed structure of martensite and retained austenite. The upper and lower cooling water ratio is within this range, reducing the disordered flow of cooling water on an upper surface, making the upper and lower surfaces cooled uniformly, and improving the uniformity of a thickness section.

The reason why the coiling temperature is controlled at 300-400° C. and the coiling tension is controlled to be 10-20 t in the present disclosure is that under this composition system, the coiling temperature within this range is conducive to self-tempering of the steel plate to a certain extent, and a certain amount of retained austenite can be obtained, which is conducive to improving the machinability of the steel plate, reducing the difficulty of improving the plate shape in the uncoiling and flattening process, and optimizing the plate shape of the finished steel plate. A proper coiling tension can not only ensure an excellent original coil shape, but also ensure an excellent original coil plate shape after the tail of the steel plate loses tension.

Compared with the prior art, the present disclosure has the advantages that on the premise that the tensile strength of the steel plate is greater than or equal to 1100 MPa and the elongation is greater than or equal to 12%, the steel plate has a surface Brinell hardness of 330-390 and a core hardness that is 95% or above of the surface hardness, so that the steel plate has higher hardness uniformity in a thickness direction, and the service life is prolonged by 20% or above compared with that of wear-resistant steel of the same grade. Alloying elements are simple, and no expensive elements are added. Furthermore, tempering is not required, but only online quenching is used, so that the production flow is short, the energy consumption can be reduced by at least 15%, and the waviness does not exceed 4.5 mm/m.

BRIEF DESCRIPTION OF THE DRAWINGS

FIG. 1 is a metallographic structure diagram of steel of the present disclosure.

DETAILED DESCRIPTION OF THE EMBODIMENTS

The present disclosure is described in detail below:

Table 1 shows values of chemical components in Embodiments and control groups of the present disclosure;

Table 2 shows values of main process parameters in Embodiments and control groups of the present disclosure; and Table 3 shows property detection and results in Embodiments and control groups of the present disclosure.

The embodiments achieve production according to the following steps:

1) desulfurizing molten iron, smelting the desulfurized molten iron, and casting into a blank;
2) heating the casting blank: a heating temperature is controlled at 1220-1270° C., and the temperature is maintained for at least 60 min; a total duration in a furnace is controlled to be 140 min or more; and a temperature difference in a plate thickness direction is controlled to not exceed 5° C.;
3) performing rough rolling, wherein a rough rolling end temperature is controlled at 1050-1110° C., and a thickness of an intermediate plate at the end is 30-50 mm;
4) performing finish rolling, wherein an initial rolling temperature is controlled at 950-1050° C., a rolling speed is controlled to be 2-7 m/s, and a final rolling temperature of the finish rolling is controlled to be 830-880° C.;
5) performing rapid cooling, namely cooling to 350° C. or below at a cooling rate of 40-150° C./s, and an upper and lower cooling water ratio is controlled to be 45:55-75:80;
6) performing coiling, wherein a coiling temperature is controlled at 300-400° C., and a coiling tension is controlled to be 10-20 t; and
7) performing conventional temper rolling to control a waviness to not exceed 4.5 mm/m.

TABLE 1

Chemical components (wt %) in Embodiments and control groups of the present disclosure

| Group | C/% | Si % | Mn % | P % | S % | Cr % | Mo % | Nb % | Als % | Ti % | B % | N % |
|---|---|---|---|---|---|---|---|---|---|---|---|---|
| 1 | 0.08 | 0.39 | 1.32 | 0.012 | 0.003 | — | — | — | 0.010 | 0.012 | 0.0012 | 0.005 |
| 2 | 0.21 | 0.14 | 0.95 | 0.007 | 0.002 | — | — | — | 0.017 | 0.027 | 0.0024 | 0.006 |
| 3 | 0.178 | 0.10 | 1.36 | 0.011 | 0.004 | — | — | — | 0.038 | 0.024 | 0.0031 | 0.004 |
| 4 | 0.127 | 0.25 | 1.23 | 0.006 | 0.005 | — | — | — | 0.034 | 0.005 | 0.0010 | 0.005 |
| 5 | 0.186 | 0.26 | 1.09 | 0.009 | 0.002 | — | — | — | 0.014 | 0.008 | 0.0024 | 0.004 |
| 6 | 0.22 | 0.72 | 0.80 | 0.008 | 0.005 | — | — | — | 0.058 | 0.009 | 0 | 0.006 |
| 7 | 0.109 | 0.18 | 0.87 | 0.007 | 0.003 | — | — | — | 0.019 | 0.011 | 0.0013 | 0.003 |
| 8 | 0.116 | 0.29 | 1.32 | 0.008 | 0.005 | — | — | — | 0.029 | 0.009 | 0.0032 | 0.005 |
| 9 | 0.106 | 0.42 | 1.14 | 0.010 | 0.003 | — | — | — | 0.018 | 0.008 | 0.0050 | 0.006 |
| 10 | 0.163 | 0.16 | 1.58 | 0.011 | 0.004 | — | — | — | 0.060 | 0.030 | 0.0024 | 0.007 |

TABLE 1-continued

Chemical components (wt %) in Embodiments and control groups of the present disclosure

| Group | C/% | Si % | Mn % | P % | S % | Cr % | Mo % | Nb % | Als % | Ti % | B % | N % |
|---|---|---|---|---|---|---|---|---|---|---|---|---|
| Control Group 1 | 0.16 | 0.35 | 1.5 | 0.010 | 0.003 | 0.65 | — | 0.015 | 0.021 | 0.015 | 0.0015 | 0.005 |
| Control Group 2 | 0.15 | 0.32 | 1.2 | 0.009 | 0.002 | 0.58 | 0.30 | — | | 0.017 | 0.0018 | 0.005 |

TABLE 2

Main process parameters in Embodiments and control groups of the present disclosure

| Group | Heating temperature ° C. | Heat preservation time min | Total duration in a furnace min | Rough rolling End temperature ° C. | Thickness of intermediate slab mm | Initial rolling temperature of finish rolling ° C. | Final rolling temperature ° C. |
|---|---|---|---|---|---|---|---|
| 1 | 1259 | 87 | 157 | 1110 | 45 | 983 | 873 |
| 2 | 1270 | 71 | 140 | 1077 | 30 | 950 | 830 |
| 3 | 1252 | 60 | 162 | 1099 | 38 | 964 | 839 |
| 4 | 1239 | 73 | 146 | 1050 | 32 | 954 | 845 |
| 5 | 1243 | 64 | 150 | 1074 | 37 | 980 | 835 |
| 6 | 1220 | 80 | 144 | 1062 | 50 | 1050 | 880 |
| 7 | 1246 | 74 | 163 | 1075 | 42 | 954 | 836 |
| 8 | 1224 | 64 | 155 | 1088 | 38 | 954 | 831 |
| 9 | 1243 | 71 | 145 | 1109 | 41 | 978 | 850 |
| 10 | 1223 | 70 | 152 | 1085 | 49 | 974 | 870 |
| Control Group 1 | 1284 | 90 | 166 | 1080 | 45 | 1003 | 880 |
| Control Group 2 | 1260 | 101 | 175 | 1060 | 58 | 938 | 850 |

| Group | Rolling speed m/s | Cooling rate ° C./s | Upper and lower water ratio | Cross side water spraying aperture | Water pressure bar | Coiling temperature ° C. | Coiling tension t | Quenching |
|---|---|---|---|---|---|---|---|---|
| 1 | 6.1 | 122 | 45:55 | Fully opened | 1.8 | 333 | 23 | Online |
| 2 | 5.6 | 118 | 50:60 | Fully opened | 0.8 | 377 | 13 | Online |
| 3 | 3.4 | 100 | 50:55 | Fully opened | 0.9 | 318 | 20 | Online |
| 4 | 6.3 | 87 | 65:70 | Fully opened | 1.1 | 334 | 24 | Online |
| 5 | 6.1 | 78 | 70:80 | Fully opened | 1.4 | 311 | 12 | Online |
| 6 | 7.0 | 40 | 75:80 | Fully opened | 1.5 | 336 | 29 | Online |
| 7 | 4.2 | 143 | 60:70 | Fully opened | 1.9 | 303 | 16 | Online |
| 8 | 4.5 | 120 | 60:70 | Fully opened | 1.0 | 319 | 27 | Online |
| 9 | 3.2 | 140 | 45:50 | Fully opened | 0.9 | 315 | 24 | Online |
| 10 | 2.1 | 150 | 70:75 | Fully opened | 0.9 | 372 | 23 | Online |
| Control Group 1 | 5.6 | 22 | 30:40 | Fully opened | 0.9 | 640 | 30 | 890° C.*30 min |
| Control Group 2 | 6.2 | 26 | 35:45 | Fully opened | 1.2 | 610 | 28 | 890° C.*36 min |

TABLE 3

Mechanical property detection results in Embodiments and control groups of the present disclosure

| Group | Tensile strength MPa | Elongation A % | W10/3000 (surface) HB | | | W10/3000 (core) HB | Cold bending property |
|---|---|---|---|---|---|---|---|
| 1 | 1128 | 12 | 348 | 341 | 375 | 343 | D = 4a, qualified at 180° |
| 2 | 1160 | 13 | 347 | 350 | 348 | 334 | D = 4a, qualified at 180° |
| 3 | 1193 | 14 | 371 | 343 | 361 | 348 | D = 4a, qualified at 180° |
| 4 | 1171 | 12 | 351 | 362 | 347 | 339 | D = 4a, qualified at 180° |
| 5 | 1203 | 14 | 360 | 369 | 362 | 356 | D = 4a, qualified at 180° |
| 6 | 1124 | 12 | 366 | 379 | 346 | 356 | D = 4a, qualified at 180° |
| 7 | 1184 | 14 | 359 | 353 | 365 | 348 | D = 4a, qualified at 180° |
| 8 | 1206 | 13 | 372 | 372 | 348 | 348 | D = 4a, qualified at 180° |

TABLE 3-continued

Mechanical property detection results in Embodiments and control groups of the present disclosure

| Group | Tensile strength MPa | Elongation A % | W10/3000 (surface) HB | | | W10/3000 (core) HB | Cold bending property |
|---|---|---|---|---|---|---|---|
| 9 | 1205 | 12 | 374 | 348 | 370 | 351 | D = 4a, qualified at 180° |
| 10 | 1217 | 13 | 365 | 377 | 358 | 363 | D = 4a, qualified at 180° |
| Control Group 1 | 1260 | 10.5 | 390 | 398 | 400 | 375 | D = 4a, qualified at 90° cracked at 180° |
| Control Group 2 | 1201 | 11 | 410 | 412 | 418 | 375 | D = 4a, qualified at 90° cracked at 180° |

It can be seen from Table 3 that under the condition that the chemical components are fewer (without Cr, Nb and Mo), the Brinell hardness is 341-379; the core hardness in the thickness direction is at least 96% or above of the surface hardness; and the cold bending property can satisfy D=4a, qualified at 180°. However, since the alloy content in the control groups is higher, the core hardness can only be 90-94% of the surface hardness, and the cold bending property can only satisfy D=4a, qualified at 90°.

The above embodiments are only optimal examples, but are not intended to limit the implementations of the present disclosure.

What is claimed is:

1. A method for producing a tempering-free wear-resistant hot rolled strip, the tempering-free wear-resistant hot rolled strip comprising the following components in percentage by weight: 0.08-0.22% of C, 0.1-0.55% of Si, 0.8-1.5% of Mn, less than or equal to 0.012% of P, less than or equal to 0.005% of S, 0.01-0.055% of Als, 0.005-0.019% of Ti, less than or equal to 0.007% of N, and the balance of Fe and impurities, and a structure is lath martensite; the method comprising the following steps:

1) desulfurizing molten iron, smelting the desulfurized molten iron, and casting into a blank;
2) heating the casting blank: wherein a heating temperature is controlled at 1220-1270° C., and the temperature is maintained for at least 60 min; a total duration in a furnace is controlled to be 140 min or more; and a temperature difference in a plate thickness direction is controlled to not exceed 5° C.;
3) performing rough rolling, wherein a rough rolling end temperature is controlled at 1050-1110° C., and a thickness of an intermediate plate after rough rolling is 30-50 mm;
4) performing finish rolling, wherein an initial rolling temperature is controlled at 950-1050° C., a rolling speed is controlled to be 2-7 m/s, and a final rolling temperature of the finish rolling is controlled to be 830-880° C.;
5) performing rapid cooling, namely cooling to 350° C. or below at a cooling rate of 40-150° C./s, and controlling an upper and lower cooling water ratio to be 45:55-75:80;
6) performing coiling, wherein a coiling temperature is controlled at 300-400° C., and a coiling tension is controlled to be 10-20 t; and
7) performing conventional temper rolling to control a waviness to not exceed 4.5 mm/m.

2. The method according to claim 1, wherein the casting blank is heated at 1228-1263° C.

3. The method according to claim 1, wherein the coiling is performed at 325-380° C.

* * * * *